US010888880B2

(12) United States Patent
Törnblom

(10) Patent No.: US 10,888,880 B2
(45) Date of Patent: Jan. 12, 2021

(54) CONICAL DISK HAVING A CHECK VALVE, AND A CENTRIFUGE ROTOR, A CENTRIFUGAL SEPARATOR, AND A METHOD OF SEPARATION USING THE CONICAL DISK

(71) Applicant: ALFA LAVAL CORPORATE AB, Lund (SE)

(72) Inventor: Olle Törnblom, Tullinge (SE)

(73) Assignee: ALFA LAVAL CORPORATE AB, Lund (SE)

( * ) Notice: Subject to any disclaimer, the term of this patent is extended or adjusted under 35 U.S.C. 154(b) by 184 days.

(21) Appl. No.: 16/070,444

(22) PCT Filed: Feb. 20, 2017

(86) PCT No.: PCT/EP2017/053785
§ 371 (c)(1),
(2) Date: Jul. 16, 2018

(87) PCT Pub. No.: WO2017/144410
PCT Pub. Date: Aug. 31, 2017

(65) Prior Publication Data

US 2018/0345298 A1 Dec. 6, 2018

(30) Foreign Application Priority Data

Feb. 22, 2016 (EP) ..... 16156722

(51) Int. Cl.
*B04B 5/12* (2006.01)
*B04B 7/14* (2006.01)
(Continued)

(52) U.S. Cl.
CPC ..... *B04B 5/12* (2013.01); *B04B 1/08* (2013.01); *B04B 7/14* (2013.01); *B04B 9/06* (2013.01); *B04B 7/02* (2013.01); *B04B 2005/125* (2013.01)

(58) Field of Classification Search
CPC .... B04B 1/04; B04B 1/08; B04B 7/12; B04B 7/14; B04B 5/12; B04B 9/06; B04B 7/02; B04B 2005/125; B01D 45/12
(Continued)

(56) References Cited

U.S. PATENT DOCUMENTS 3,519,199 A 7/1970 Todd
3,741,467 A 6/1973 Kjellgren
(Continued)

FOREIGN PATENT DOCUMENTS

CN 1179736 A 4/1998
DE 654319 C 12/1937
(Continued)

OTHER PUBLICATIONS

International Search Report (PCT/ISA/210) issued in PCT/EP2017/053785, dated May 15, 2017.
(Continued)

*Primary Examiner* — Charles Cooley
(74) *Attorney, Agent, or Firm* — Birch, Stewart, Kolasch & Birch, LLP

(57) ABSTRACT

A centrifuge rotor for a centrifugal separator for separation of a relatively heavy phase of a fluid from a relatively light phase of the fluid is disclosed. The centrifuge rotor includes a stack of conical disks, and has a central axis of rotation. Each conical disk has an outward surface and an inward surface. The stack of conical disks includes a plurality of interspaces between adjacent conical disks. The interspaces include first interspaces for separation of the relatively
(Continued)

heavy phase from the relatively light phase, and second interspaces. A check valve device is provided in each second interspace for closing the second interspace in an inward direction towards the central axis, and permitting opening of the second interspace in an outward direction. Also a centrifugal separator, a method for separation and a conical disk are disclosed.

20 Claims, 5 Drawing Sheets

(51) Int. Cl.
*B04B 1/08* (2006.01)
*B04B 9/06* (2006.01)
*B04B 7/02* (2006.01)

(58) Field of Classification Search
USPC ..... 494/67–73
See application file for complete search history.

(56) References Cited

U.S. PATENT DOCUMENTS

| | | | | |
|---|---|---|---|---|
| 5,851,396 | A | 12/1998 | Saget | |
| 8,425,670 | B2 | 4/2013 | Carlsson et al. | |
| 8,678,989 | B2 * | 3/2014 | Rudman | B04B 1/08 494/73 |
| 9,687,858 | B2 * | 6/2017 | Quiter | B04B 1/08 |
| 2014/0371049 | A1 | 12/2014 | Nilsson et al. | |
| 2015/0119225 | A1 * | 4/2015 | Inge | B04B 5/12 494/70 |
| 2016/0001302 | A1 | 1/2016 | Quiter et al. | |
| 2018/0345298 | A1 * | 12/2018 | Tornblom | B04B 7/14 |

FOREIGN PATENT DOCUMENTS

| | | | | |
|---|---|---|---|---|
| DE | 36 19 926 | A1 | 1/1987 | |
| DE | 10 2008 030 028 | A1 | 12/2009 | |
| DE | 10 2009 018 000 | A1 | 12/2010 | |
| EP | 2 735 351 | A1 | 5/2014 | |
| EP | 3207996 | A1 * | 8/2017 | B04B 1/08 |
| JP | 2704523 | B2 | 1/1998 | |
| RU | 2007221 | C1 | 2/1994 | |
| RU | 2 182 525 | C1 | 5/2002 | |
| SU | 1261715 | A1 | 10/1986 | |
| WO | WO 96/22835 | A1 | 8/1996 | |
| WO | WO 2014/128063 | A2 | 8/2014 | |

OTHER PUBLICATIONS

Written Opinion (PCT/ISA/237) issued in PCT/EP2017/053785, dated May 15, 2017.

* cited by examiner

CONICAL DISK HAVING A CHECK VALVE, AND A CENTRIFUGE ROTOR, A CENTRIFUGAL SEPARATOR, AND A METHOD OF SEPARATION USING THE CONICAL DISK

TECHNICAL FIELD OF THE INVENTION

The invention refers to a centrifuge rotor for a centrifugal separator for separation of a relatively heavy phase of a fluid from a relatively light phase of the fluid, the centrifuge rotor comprising a stack of conical disks, the centrifuge rotor having a central axis of rotation around which the conical disks are concentrically provided, each conical disk having an outward surface and an inward surface, and comprising a central opening, the stack of conical disks comprising a plurality of interspaces between adjacent conical disks, the interspaces comprising first interspaces for separation of the relatively heavy phase from the relatively light phase, and at least one second interspace provided adjacent to one of the first interspaces.

The invention also refers to a centrifugal separator for separation of a relatively heavy phase of a fluid from a relatively light phase of the fluid.

Furthermore, the invention refers to a method for separation of a relatively heavy phase of a fluid from a relatively light phase of the fluid, the centrifuge rotor comprising a stack of conical disks, the centrifuge rotor having a central axis of rotation around which the conical disks are concentrically provided, each conical disk having an outward surface and an inward surface, and comprising a central opening, the stack comprising a plurality of interspaces between adjacent conical disks, the interspaces comprising first interspaces and at least one second interspace provided adjacent to one of the first interspaces, the method comprising the steps of rotating the centrifuge rotor, supplying the fluid and conveying the fluid into the first interspace in which the relatively heavy phase is separated from the relatively light phase.

Still further, the invention refers to a conical disk for a centrifuge rotor for a centrifugal separator for separation of a relatively heavy phase of a fluid from a relatively light phase of the fluid, the conical disk having a central axis of rotation around which the conical disk is concentrically provided, the conical disk having an outward surface and an inward surface, and comprising a central opening.

BACKGROUND OF THE INVENTION AND PRIOR ART

Gas-liquid centrifugal separators having a centrifuge rotor comprising a stack of conical disks and working according to the counter flow principle have been seen to have a decreasing efficiency with increasing gas pressures.

Counter flow separation means that the separated relatively heavy phase, which may consist of liquid such as oil, or condensed natural gas, is supposed to go radially outwards and the relatively light phase, which may consist of gas, such as natural gas, is supposed to go radially inwards.

In a natural gas flow, the fluid properties of both the gas and the liquid change with the system pressure. Increasing the pressure increases the density of the gas but decrease the density of the liquid, as lighter fractions condensate, the viscosity of the liquid and the surface tension of the liquid. It has been noted that the increasing pressure results in a decreasing separation efficiency, which means that a part of the relatively heavy phase may follow the relatively light phase inwards and out of the centrifugal separator.

EP 2 735 351 discloses a centrifugal separator for separating particles from a gas stream. The separator comprises a frame, a gas inlet and a gas outlet. A centrifuge rotor is rotatable in the frame around a rotational axis and comprises a plurality of separation plates defining separation passages between the plates. A central gas chamber in the rotor communicates with a radially inner portion of the separation passages and the gas inlet. A device brings the gas stream in rotation upstream of the rotor. The rotor is configured such that the rotational flow of the gas mixture drives the rotation of the rotor for separating particles from the same gas stream being conducted from the space surrounding the rotor, through the separation passages between the plates and towards the central gas chamber.

U.S. Pat. No. 8,425,670 discloses a plant for separation of oil or mist from a fossil gas mixture. The plant comprises a centrifugal separator with a casing defining a separation space. An inlet for the gas mixture to the separation space is provided. A centrifuge rotor is arranged in the separation space.

SUMMARY OF THE INVENTION

The object of the invention is to remedy the above discussed problem, and to achieve a more efficient separation of a relatively heavy phase from a fluid. More specifically, it is aimed at a solution to the problem of decreasing separation efficiency when the pressure increases in a centrifuge rotor operated according to the counter flow principle.

The Centrifuge Rotor

The object is achieved by the centrifuge rotor initially defined, which is characterized in that a check valve device is provided in the at least one second interspace for closing the at least one second interspace in an inward direction towards the central axis of rotation, and permitting opening of the at least one second interspace in an outward direction, being opposite to the inward direction.

When operating the centrifuge rotor, the fluid will enter the first interspaces, wherein the relatively light phase may flow inwards in the first interspaces and at least a part of the relatively heavy phase will due to the centrifugal forces flow outwards. Any part of the relatively heavy phase, which may flow inwards together with the flow of the relatively light phase in the first interspaces may be pulled into the second interspace, via a passage from one of the first interspaces to the second interspace, and then flow in the outward direction in the second interspace by means of the centrifugal force, and thus radially out from the centrifuge rotor.

Thanks to the invention, it is thus possible to achieve an efficient separation of the relatively heavy phase from the fluid, and to obtain a very pure relatively light phase, for instance a very pure natural gas.

The invention is thus applicable to the purification of gases, such as natural gases. However, the invention is also applicable to the separation of a relatively heavy liquid phase from a relatively light liquid phase of a liquid fluid, especially liquid fluids with large density differences or large viscosity differences between the heavy and light phases.

According to an embodiment of the invention, the centrifuge rotor may comprise more than one second interspace, for instance, a plurality of second interspaces, wherein the first and second interspaces are arranged in an alternating order in the centrifuge rotor. A valve device may be provided in each of the second interspaces.

According to an embodiment of the invention, the conical disks comprise, or consists of, a plurality first conical disks and at least one second conical disk, wherein the at least one second interspace is formed between the at least one second conical disk and one of the first conical disks.

According to an embodiment of the invention, the conical disks comprise, or consists of, a plurality of first conical disks and a plurality of second conical disks, wherein the first and second conical disks are arranged in an alternating order in the centrifuge rotor.

According to an embodiment of the invention, the check valve device comprises at least one first valve member closing the at least one second interspace in the inward direction. The first valve member may extend 360°, i.e. around the whole circumference, of the second conical disk. It is also possible to provide several first valve members distributed around the circumference of the second conical disk. The first valve member, or the first valve members, may extend along a part of the circumference of the second conical disk, wherein the remaining part of the circumference is covered by closing elements, which thus may alternate with first valve members.

According to an embodiment of the invention, the first valve member, or the first valve members, extends between one of the second conical disks and the at least one first conical disks.

According to an embodiment of the invention, the first valve member is attached to the outward surface of the at least one second conical disk. The first valve member, or the first valve members, may be attached by any suitable joining means, for instance by gluing, by clamping, by fasteners such as screws, pins or rivets, etc., or by a combination of several of the joining means.

According to an embodiment of the invention, the first valve member may be flexible. For instance by being made of a flexible material, such as rubber, a polymer, a textile etc., or by having a flexible portion. The flexibility of the first valve member may permit the first valve member to move between an opening position along the outward surface of the at least one second conical disk and a closing position against the inward surface of the opposite first conical disk. In the closing position the first valve member may extend in an outward direction with respect to the central axis of rotation, wherein an outermost edge of the first valve member abuts the inward surface of the opposite first conical disk.

According to an embodiment of the invention, the first valve member is configured to close the at least one second interspace by means of the centrifugal force upon rotation of the centrifuge rotor. The centrifugal force will thus when the centrifuge rotor rotates bring the first valve member to the closing position, wherein the outermost edge of the first valve member may abut the inward surface of the opposite first conical disk.

The relatively heavy phase, flowing outwards in the second interspace, may due to the action of the centrifugal force press the first valve member away from the abutment against the inward surface of the opposite first conical disk to permit a flow the relatively heavy phase to pass the first valve member.

According to an embodiment of the invention, the at least one second conical disk comprises a passage from the first interspace to the second interspace. Such a passage may permit the relatively heavy phase, possibly flowing inwards in the first interspace, to be pulled into the at least one second interspace, where it may flow outwards.

According to an embodiment of the invention, the first conical disks have an inner edge at a first radial distance from the central axis of rotation, wherein the passage is located at a radial distance from the central axis of rotation that is greater than the first radial distance. The relatively heavy phase, which may flow in the first interspace, may thus be pulled into the second interspace before it comes into contact with the flow of the relatively light phase in the central chamber defined by the central opening of the conical disks.

According to an embodiment of the invention, the passage comprises an aperture, which extends through the at least one second conical disk and is provided upstream the first valve member with respect to the outward direction.

According to an embodiment of the invention, the passage is formed by an inner edge of the at least one second conical disk, wherein the inner edge of the second conical disk is located at a second radial distance from the central axis of rotation that is greater than the first radial distance.

According to an embodiment of the invention, the passage is formed by a recess in the inner edge of the at least one second conical disk, wherein the recess, or a bottom of the recess, is located at a radial distance from the central axis of rotation that is greater than the first radial distance.

According to an embodiment of the invention, the at least one second conical disk comprises a closing member protruding from the outward surface, wherein the closing member closes the second interspace and is provided upstream the aperture with respect to the outward direction. The closing member may prevent the relatively heavy phase from reaching the central chamber via the second interspace, and may advantageously extend 360° in a circumferential direction.

According to a further embodiment of the invention, the valve device comprises at least one second valve member closing the at least one second interspace, wherein the first and second valve members are provided in series after each other with respect to the outward direction. The second valve member may arranged in the same way and may have the same configuration as the first valve member.

According to a further embodiment of the invention, the centrifuge rotor comprises a central chamber inside the central opening of the conical disks, wherein centrifuge rotor is configured to permit the relatively light phase to flow in the inward direction in the first interspaces into the central chamber.

The Centrifugal Separator

The object is also achieved by the centrifugal separator initially defined, which comprises a casing enclosing a separation space, a centrifuge rotor as defined above, and a device for rotating the fluid and the centrifuge rotor around the central axis of rotation in the separation space.

According to a further embodiment of the invention, the centrifugal separator comprises an inlet for the fluid, an outlet for the relatively heavy phase and an outlet for the relatively light phase.

According to a further embodiment of the invention, the central chamber of the centrifuge rotor forms an outlet chamber communicating with the outlet for the relatively light phase.

According to a further embodiment of the invention, the drive member comprises a drive motor or a turbine wheel driven by the fluid to be separated.

The Method of Separation

The object is also achieved by the method initially defined, which is characterized by the steps of closing the at least one second interspace in an inward direction towards the central axis of rotation, and permitting opening of the at least one second interspace in an outward direction, being opposite to the inward direction, for the relatively heavy phase.

The Conical Disk

The object is also achieved by the conical disk initially defined, which is characterized in that the conical disk comprises at least one first valve member of a check valve device, and that the first valve member is configured to close in an inward direction towards the central axis of rotation, and to open in an outward direction, being opposite to the inward direction, wherein the first valve member is movable between an opening position, along the outward surface of the conical disk, and a closing position, in which the first valve member extends in the outward direction with respect to the central axis of rotation.

According to an embodiment of the invention, the first valve member is attached to the outer surface of the conical disk and extends in an outward direction with respect to the central axis of rotation.

According to an embodiment of the invention, the first valve member has an outermost edge being movable away from and towards the outer surface.

The first valve member may extend 360°, i.e. around the whole circumference, of the conical disk. It is also possible to provide several first valve members distributed around the circumference of the conical disk. The first valve member, or the first valve members, may extend along a part of the circumference of the conical disk, wherein the remaining part of the circumference is covered by closing elements, which thus may alternate with first valve members.

According to an embodiment of the invention, the first valve member, or the first valve members, is attached to the outward surface by any suitable joining means, for instance by gluing, by clamping, by fasteners such as screws, pins or rivets, etc., or by a combination of several of the joining means.

According to an embodiment of the invention, the first valve member may be flexible. For instance by being made of a flexible material, such as rubber, a polymer, a textile etc., or by having a flexible portion. The flexibility of the first valve member may permit the first valve member to move between an opening position along the outward surface of the conical disk and a closing position against an inward surface of an opposite conical disk. In the closing position the first valve member may extend in an outward direction with respect to the central axis of rotation, wherein the outermost edge of the first valve member is located above and at a distance from the outward surface of the conical disk.

According to an embodiment of the invention, the first valve member is configured to be brought to the closing position by the centrifugal force upon rotation of the conical disk.

According to an embodiment of the invention, the conical disk comprises an aperture permitting a flow through the conical disk, wherein the aperture is provided more closely to the central axis of rotation than the first valve member. The aperture may thus be provided upstream the first valve member with respect to the outward direction.

According to an embodiment of the invention, the passage may be formed by a recess in the inner edge of the conical disk.

According to an embodiment of the invention, the conical disk comprises a closing member projecting from the outward surface and provided upstream the aperture with respect to the outward direction. The closing member may prevent the relatively heavy phase from flowing inwards, and may advantageously extend 360° in a circumferential direction.

According to an embodiment of the invention, the check valve device comprises at least one second valve member, wherein the first and second valve members are provided in series after each other with respect to the outward direction. The second valve member may arranged in the same way and may have the same configuration as the first valve member.

BRIEF DESCRIPTION OF THE DRAWINGS

The invention is now to be explained more closely through a description of various embodiments and with reference to the drawings attached hereto.

DETAILED DESCRIPTION OF VARIOUS EMBODIMENTS

Figure 1:
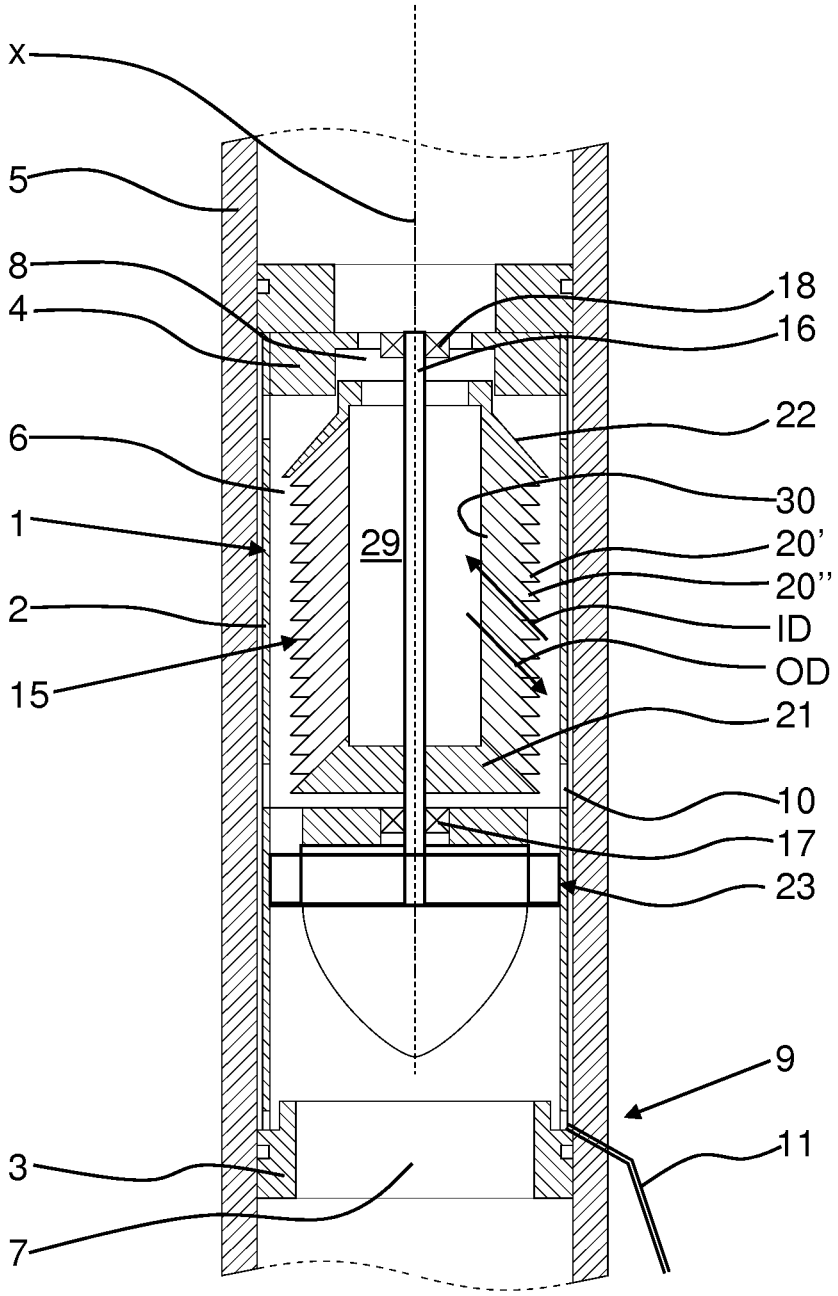
FIG. 1 discloses schematically a sectional view of a centrifugal separator according to an embodiment of the invention.
Figure 2:
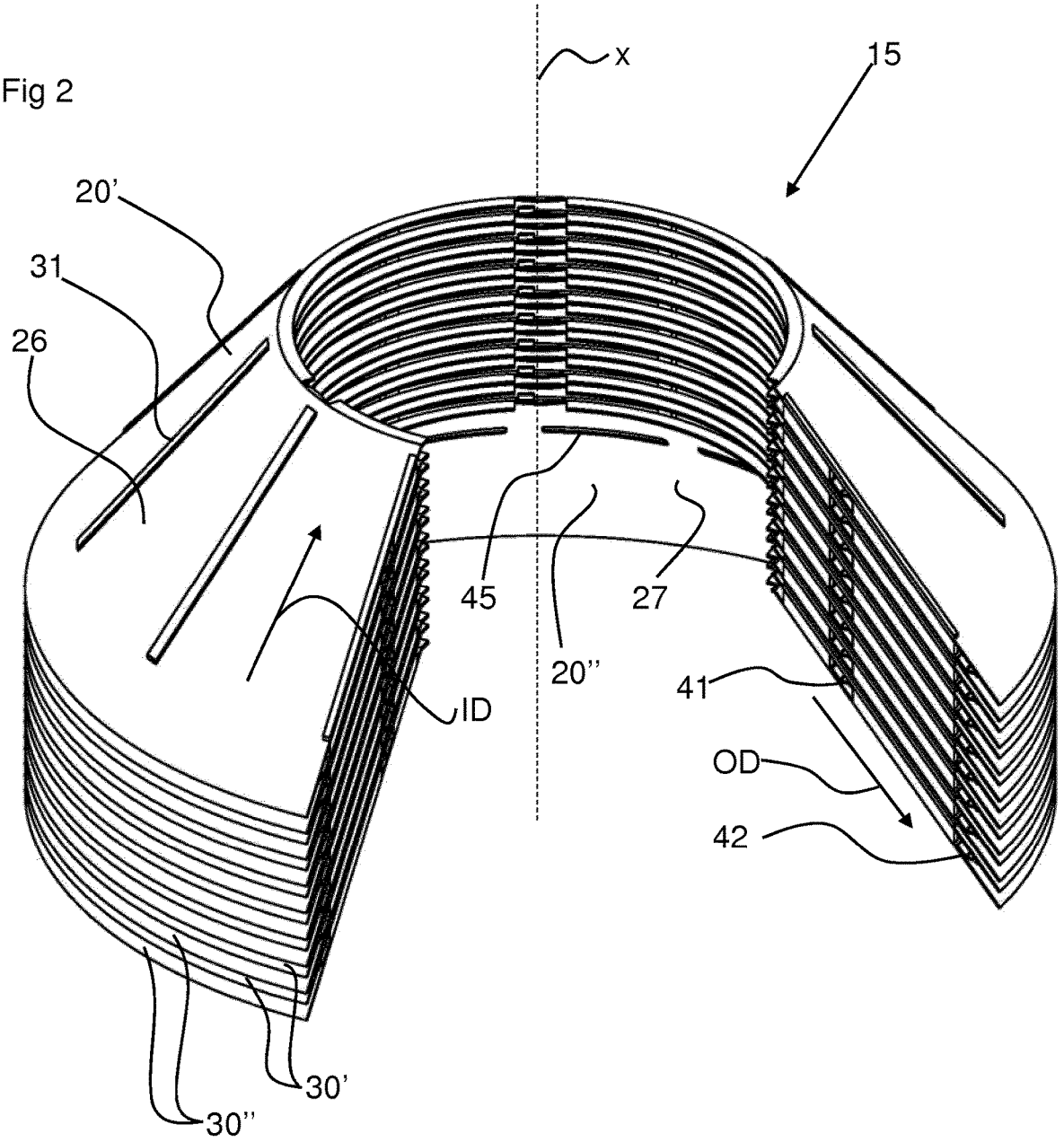
FIG. 2 discloses schematically a perspective view of a cut-out sector of a stack of conical disks of a centrifuge rotor of the centrifugal separator in FIG. 1.

FIG. 1 discloses a centrifugal separator for separation of a relatively heavy phase of a fluid from a relatively light phase of the fluid. As mentioned above, the centrifugal separator is suitable for separation or purification of various fluids, including liquid fluids, gaseous fluids, such as natural gas, etc.

The centrifugal separator is configured to be operated at high or very high pressures, for instance in the order of 50-100 bars, or even higher.

The centrifugal separator comprises a casing 1. In the embodiments disclosed, the casing 1 comprises cylindrical tube 2, an upstream end member 3 and a downstream end member 4.

In the embodiment disclosed, the casing 1, and thus the centrifugal separator, is mounted in a pipe 5 for transport of the fluid.

The casing 1 defines, or encloses, a separation space 6. The centrifugal separator also comprises an inlet 7 for the supply of the fluid and a primary outlet 8 for the relatively light phase. The inlet 7 is comprised by and extends through the upstream end member 3. The primary outlet 8 is comprised by and extends through the downstream end member 4.

Furthermore, the centrifugal separator comprises a secondary outlet 9 for the separated relatively heavy phase. The secondary outlet 9 is schematically indicated in FIG. 1, and comprises a number of openings 10 through the cylindrical tube 2, and an outlet conduit 11. The outlet conduit 11 may extend through the pipe 5.

In the embodiment disclosed, the casing 1 is stationary. It may be noted, however, that the casing 1 could also be a rotating casing provided in a stationary structure.

The centrifugal separator comprises the centrifuge rotor 15, which is provided in the separation space 6 and arranged to rotate around a central axis x of rotation.

The centrifuge rotor 15 comprises a spindle 16, which is rotatably supported by means of a first bearing 17 at a first end, forming an upstream end, of the spindle 16 and a second bearing 18 at a second end, forming a downstream end, of the spindle 16.

The centrifuge rotor 15 comprises a stack of conical disks 20', 20" which are concentrically provided with respect to the central axis x of rotation, see FIGS. 2-5. The conical disks 20', 20" are attached to the spindle 16 in a manner known per se, and may be provided between a first support disk 21 in the proximity of the first end of the spindle 16, and a second support disk 22 in the proximity of the second end of the spindle 16.

The centrifugal separator comprises a device—23 for rotating the fluid and the centrifuge rotor 15 around the central axis x of rotation in the separation space 6.

The device 23 may comprise a stationary ring shaped deflecting member comprising a plurality of vanes which are inclined with respect to the central axis x of rotation and distributed around the central axis x of rotation. The stationary vanes will bring the fluid flowing through the inlet 7 to rotate. The rotating fluid will bring the centrifuge rotor 15 to rotate around the central axis x of rotation. Such a device is disclosed in the initially mentioned document EP 2 735 351.

The device 23 may also comprise a drive member having a shaft coupled to the spindle 16 for rotating the centrifuge rotor 15 around the central axis x of rotation. The drive member may comprise a drive motor, such as an electrical motor, or a turbine wheel, driven by the fluid to be separated.

Figure 3:
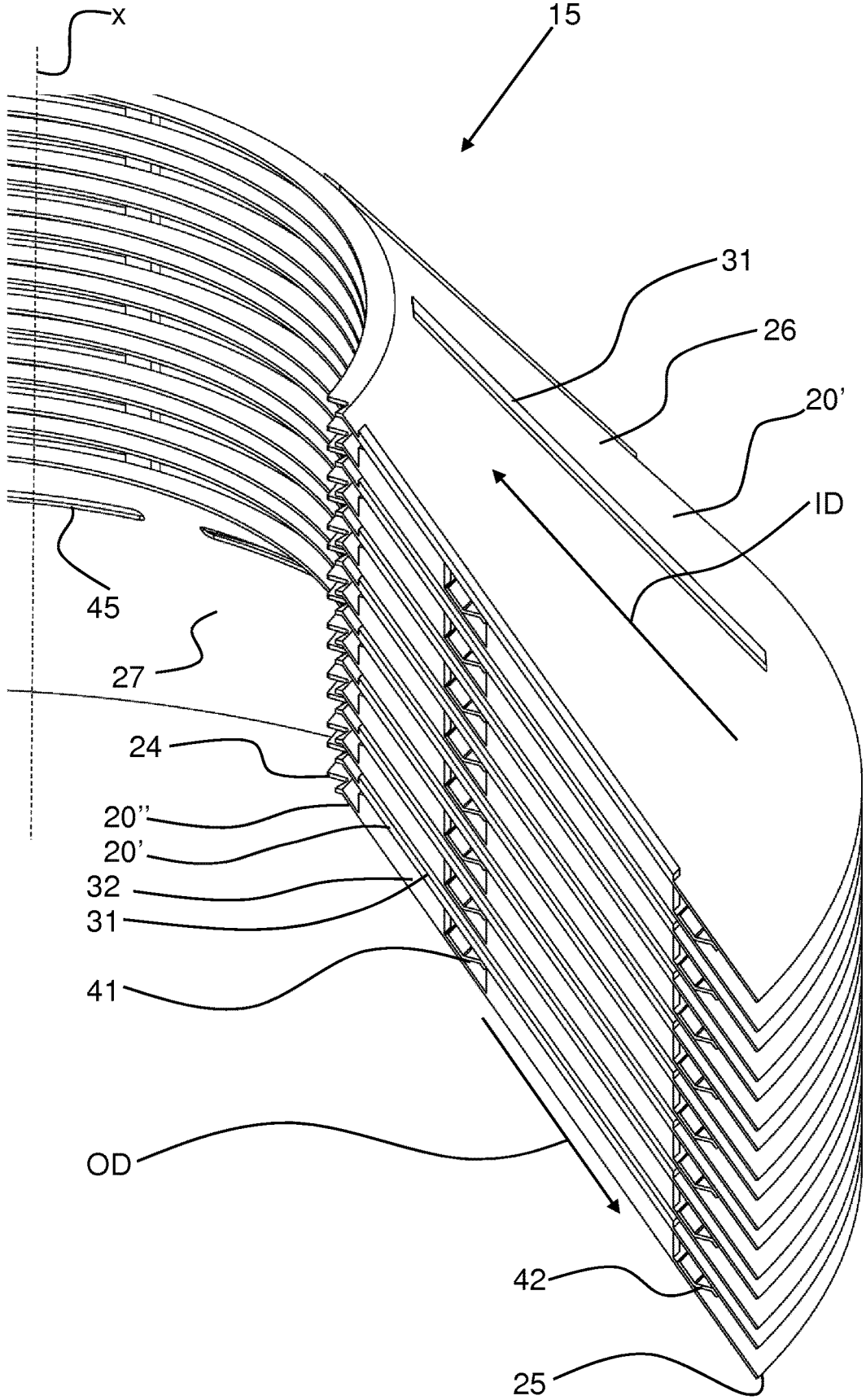
FIG. 3 discloses schematically a perspective view on a large scale of the cut-out sector in FIG. 3.

Each conical disk 20', 20" has an inner edge 24, at a first radial distance from the central axis x of rotation, and an outer edge 25, see FIG. 3.

Each of the conical disks 20', 20" has an outward surface 26 and an inward surface 27. The inward surface 27 is turned towards the central axis x of rotation.

Each conical disk 20', 20" comprises a central opening 28 defined by the inner edge 24. The central openings 28 of the conical disks 20', 20" define a central chamber 29 in the stack of conical disks 20', 20". The central chamber 29 of the centrifuge rotor 15 forms an outlet chamber communicating with the outlet 8 for the relatively light phase, as can be seen in FIG. 1.

Figure 5:
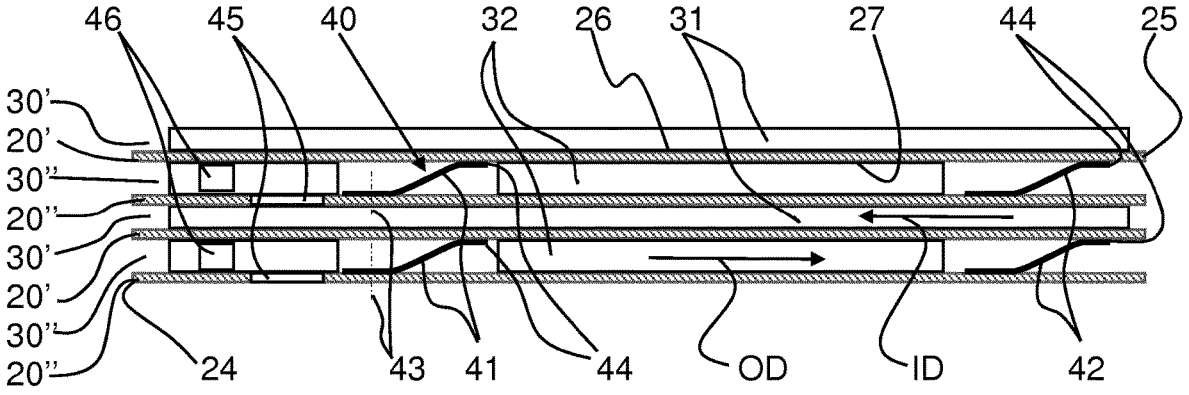
FIG. 5 discloses a sectional view of a part of four of the conical disks of the stack in FIG. 3.

The stack of conical disks 20', 20" comprises a respective interspace 30', 30" between adjacent conical disks 20', 20", see FIG. 5. It should be noted that the four conical disks 20', 20" of the centrifuge rotor 15 shown in FIG. 5, have been illustrated as extending perpendicularly to the central axis x of rotation, whereas they in the other figures have been shown with a more realistic cone angle in relation to the central axis x of rotation.

The interspaces 30', 30" comprise first interspaces 30', for separation of the relatively heavy phase from the relatively light phase, and second interspace 30". The first interspaces 30' and the second interspaces 30" are provided in an alternating order in the centrifuge rotor 15.

The height of the first interspaces 30' is defined be first distance members 31, see especially FIG. 5. The first distance members 31 extends radially outwards in the first interspaces 30'.

Figure 4:
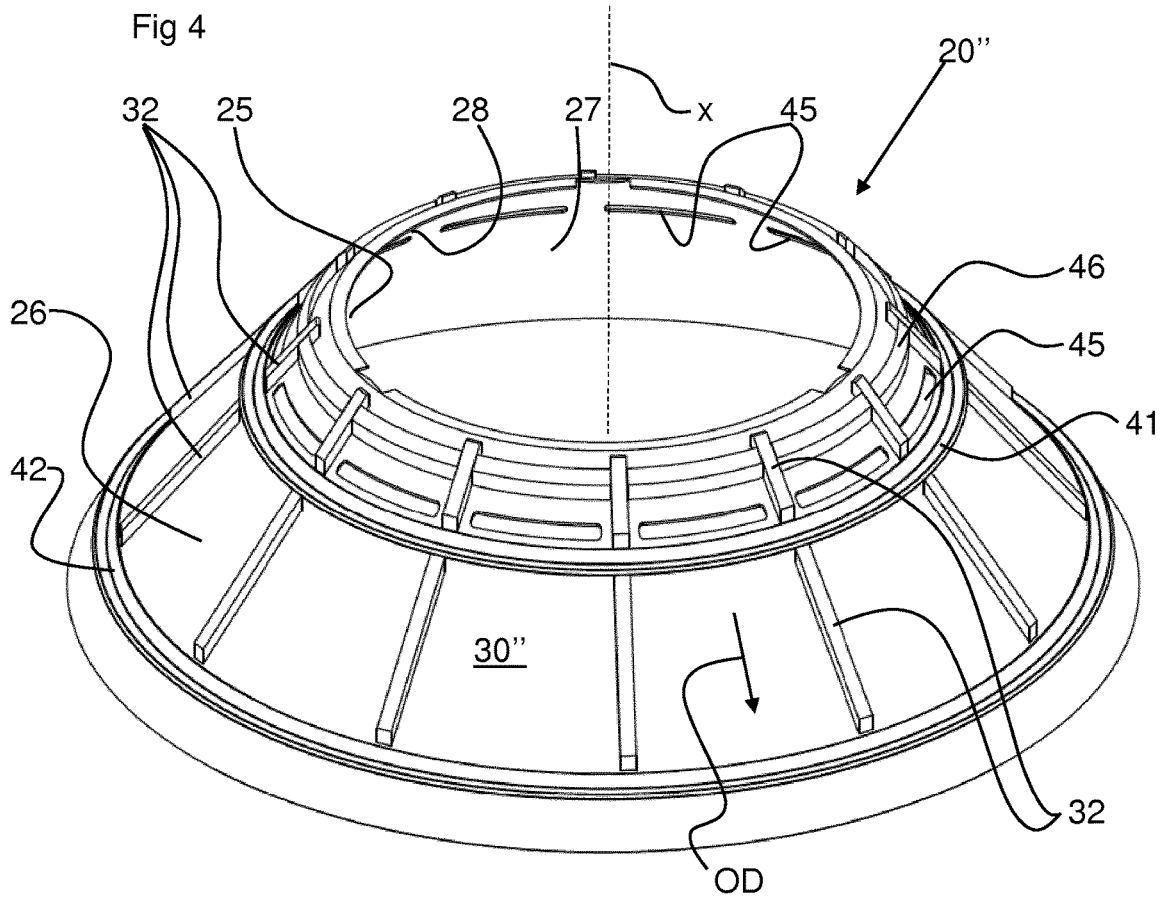
FIG. 4 discloses schematically a perspective view of a conical disk of the stack in FIG. 3.

The height of the second interspaces 30" is defined be second distance members 32, see especially FIGS. 4 and 5. The second distance members 32 extends radially outwards in the second interspaces 30". Each distance member 32 is divided in an inner part and an outer part as can be seen in FIG. 4.

In the embodiment disclosed, the height of the second interspaces 30" is greater that the height of the first interspaces 30'. This is not a requirement. The height of the first and second interspaces 30' and 30" could be equal or the height of the first interspaces 30' could be greater than the height of the second interspaces 30".

The conical disks 20', 20" comprise a plurality of first conical disks 20', forming separating disks, and a plurality of second conical disks 20". The first conical disks 20' and the second conical disks 20" are provided in an alternating order in the stack of conical disks 20', 20".

Thus, seen from the first end, one of the second interspaces 30" is formed between one of the second conical disks 20" and one of the first conical disk 20', see FIG. 5.

The centrifugal separator is configured to operate according to the counter flow principle. The fluid is thus entering the centrifugal separator via the inlet 7 and passes the drive member 23 close to the periphery of the casing 2 into the separation space 6. The fluid then enters the centrifuge rotor 15 from outside, and is conveyed into the first interspaces 30'. The relatively heavy phase is separated in the first interspaces 30' and the relatively light phase may continue inwards into the central chamber 29. From the central chamber 29 the relatively light phase is discharged from the centrifugal separator via the outlet 8.

The centrifuge rotor comprises a check valve device 40 provided in each of the second interspace 30" for closing the respective second interspace 30" in an inward direction ID towards the central axis x of rotation, and permitting opening of the respective second interspace 30" in an outward direction OD. The outward direction OD is opposite to the inward direction ID.

The check valve device 40 comprises a first valve member 41 that is configured to close in the inward direction ID towards the central axis x of rotation, and to open in the outward direction OD. Thus the first valve member 41 is closing the respective second interspace 30" in the inward direction ID. In the embodiment disclosed, the valve device 40 also comprises a second valve member 42 closing the respective second interspace 30" in the inward direction ID. The first and second valve members 41, 42 are provided in series after each other with respect to the outward direction OD.

Each of the first and second valve members 41, 42 extends between one of the second conical disks 20" and one of the first conical disks 20" as can be seen in FIG. 5. The first and second valve members 41, 42 are attached to the outward surface 26 of the second conical disk 20" by any suitable joining means, for instance by gluing, by clamping, by fasteners 43, such as screws, pins or rivets, etc., or by a combination of several of the joining means.

The first and second valve members 41, 42, see FIG. 5, extend in the outward direction OD with respect to the central axis x of rotation, and have a respective outermost edge 44, which is movable away from and towards the outer surface 26. The first and second valve members 41, 42 are flexible to permit said movability. For instance, the first and second valve members 41, 42 may be made of a flexible material, such as rubber, a polymer, a textile etc., or may have a flexible portion. The flexibility of the first and second valve members 41, 42 may thus permit the first and second valve members 41, 42 to move between an opening position along the outward surface 26 of the second conical disk 20" and a closing position against the inward surface 27 of the opposite first conical disk 21'.

In the closing position, the first and second valve members 41, 42 extend in the outward direction OD with respect to the central axis x of rotation. The outermost edge 44 is located above and at a distance from the outward surface 26 of the second conical disk 20", and abuts the inward surface 27 of the first conical disk 20'.

The first and second valve members 41, 42 extend 360°, i.e. around the whole circumference, of the second conical disk 20" as can be seen in FIG. 4. The first valve member 41 extends between the inner part and the outer part of each of the second distance members 32.

It may be noted that it is also possible to provide several first valve and second members 41, 42 distributed around the circumference of the second conical disks 20'. The first and second valve members 41, 42, may then extend along a part of the circumference of the second conical disk 20", wherein the remaining part of the circumference is covered by closing elements, which thus may alternate with first valve members.

The first and second valve members 41, 42 are configured to be brought to the closing position, shown in FIG. 5, by the centrifugal force upon rotation of the centrifuge rotor 15.

Each of the second conical disks 20" comprises a passage permitting a flow through the second conical disk 20". In the embodiment disclosed, each passage comprises an aperture 45. The aperture 45 is provided upstream the first valve member 41 with respect to the outward direction OD.

A plurality of closing members 46 are provided in each of the second interspaces 30" upstream a respective one of the apertures 45 with respect to the outward direction OD. The closing members 46 are comprised by the second conical disk 20', and project from the outward surface 26 of the second conical disk 20'. The closing members 46 prevent the relatively heavy phase from flowing inwards to the central chamber 29.

The closing members 46 extend circumferentially between adjacent pairs of the second distance members 32, as can be seen in FIG. 5. Preferably, the closing members 46 have the same height as the second distance members 32. The closing members 46, together with the width of the second distance members 32, extend 360° in the circumferential direction.

When operating the centrifugal separator, the centrifuge rotor 15 is rotated by means of the drive member 23, for instance a turbine wheel. The rotation of the centrifuge rotor 15 is then generated by the flow of the fluid, such as natural gas, which is supplied and conveyed to the separation space 6, and into the first interspace 30' in which the relatively heavy phase is separated from the relatively light phase. The relatively heavy phase is conveyed outwards in the first interspaces 30' due to the centrifugal forces. A part of the relatively heavy phase may however be flowing inwards. This part of the relatively heavy phase will flow on the inward surface 27 of the second conical disks 20' to the aperture 45, where it is pulled into the second interspace 30".

The second interspaces 30" are closed in the inward direction ID towards the central axis x of rotation by means of the first and second valve members 41, 42, thereby preventing the fluid from passing into the second interspaces 30" from outside the centrifuge rotor 15.

The first and second valve members 41, 42 will, however, permit the second interspaces 30" to be open in the outward direction OD so that the relatively heavy phase entering the second interspaces 30" via the aperture 45 may flow outwards on the inward surface 27 of the first conical disk 20' in the second interspace 30". The relatively heavy phase flowing outwards on the inward surface 27 of the first conical disk 20' will due to the action of the centrifugal force press the first valve member 41 and the second valve member 42 away from the abutment against the inward surface 27 of the first conical disk 20', and thus permit a flow the relatively heavy phase to pass the first and second valve members 41, 42, and continue outwards from the centrifuge rotor 15.

Figure 6:
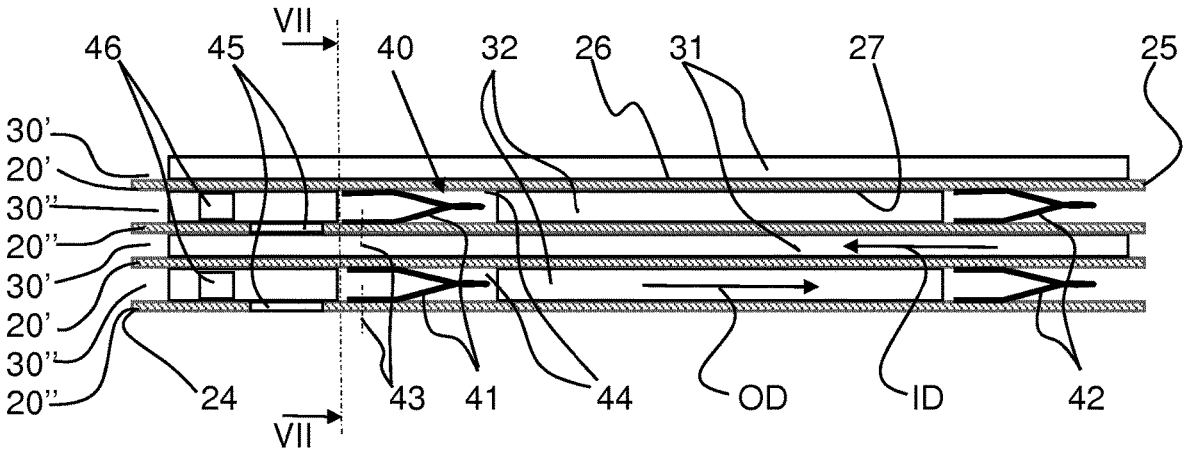
FIG. 6 discloses a sectional view, similar to the one in FIG. 6, of a part of four of the conical disks of the stack in a centrifugal separator according to a second embodiment of the invention.
Figure 7:
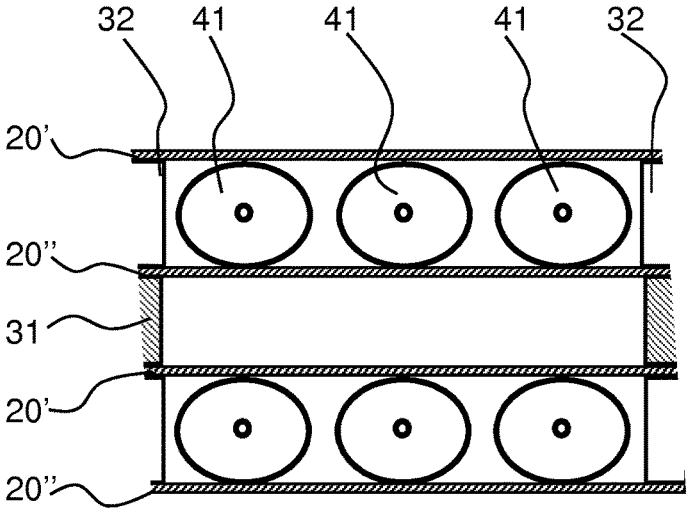
FIG. 7 discloses a sectional view along the line VII-VII in FIG. 6.

FIGS. 6 and 7 refer to a second embodiment, which differs from the first embodiment only with respect to the check valve. In the second embodiment, the check valve comprises a first valve member 41 and a second valve member 42, which both have an outwards tapering shape as can be seen in FIG. 6. As can be seen in FIG. 7, the first valve members 41 have a circular or oval cross-sectional shape seen along the outward direction OD. This is the case also for the second valve member 42. The outermost end of the valve members 41, 42 will open in an outward direction OD, at least when there is a flow outwards. The outermost end of the valve member 41, 42 will close in the inward direction at least when there is a pressure in the inward direction ID. Between the valve members 41, 42, see FIG. 7, closing elements (not disclosed) may be provided.

The invention is not limited to the embodiments disclosed but may be varied and modified within the scope of the appending claims.

For instance, the passage permitting a flow through the second conical disk 20" may instead of the aperture 45 comprise or be formed by a recess in the inner edge 24 of the second conical disk 20".

In the embodiment disclosed, a first valve member 41 and a second valve member 42 are provided. It may be noted that it is sufficient with only one of the valve members 41, 42, for instance the first valve member 41 which is provided adjacent the aperture 45. However, the invention would work also with only the second valve member 42 provided in the proximity of the outer edge 25 of the second conical disk 20".

The invention claimed is:

1. A centrifuge rotor for a centrifugal separator, the centrifuge rotor comprising:

a stack of conical disks: and a spindle having a central axis of rotation around which the conical disks are concentrically provided, wherein each conical disk has an outward surface and an inward surface, and comprises a central opening, wherein the stack of conical disks comprises a plurality of interspaces between adjacent conical disks, wherein the interspaces comprise first interspaces for separation of the relatively heavy phase from the relatively light phase, and at least one second interspace provided adjacent to one of the first interspaces, and wherein a check valve is provided in the at least one second interspace for closing the at least one second interspace in an inward direction towards the central axis of rotation, and permitting opening of the at least one second interspace in an outward direction, opposite to the inward direction.

2. The centrifuge rotor according to claim 1, wherein the conical disks comprise a plurality of first conical disks and at least one second conical disk, and wherein the at least one second interspace is formed between one of the first conical disks and the at least one second conical disk.

3. The centrifuge rotor according to claim 2, wherein the check valve comprises at least one first valve member closing the at least one second interspace in the inward direction.

4. The centrifuge rotor according to claim 3, wherein the first valve member extends between one of the at least one second conical disk and one of the first conical disks.

5. The centrifuge rotor according to claim 4, wherein the first valve member is attached to the outward surface of the at least one second conical disk.

6. The centrifuge rotor according to claim 4, wherein the first valve member is configured to close the at least one second interspace by centrifugal force upon rotation of the centrifuge rotor.

7. The centrifuge rotor according to claim 3, wherein the first valve member is attached to the outward surface of the at least one second conical disk.

8. The centrifuge rotor according to claim 7, wherein the first valve member is configured to close the at least one second interspace by centrifugal force upon rotation of the centrifuge rotor.

9. The centrifuge rotor according to claim 3, wherein the first valve member is configured to close the at least one second interspace by centrifugal force upon rotation of the centrifuge rotor.

10. The centrifuge rotor according to claim 3, wherein the at least one second conical disk comprises a passage from the first interspace to the second interspace.

11. The centrifuge rotor according to claim 10, wherein the first conical disks have an inner edge at a first radial distance from the central axis of rotation, and wherein the passage is located at a radial distance from the central axis of rotation that is greater than the first radial distance.

12. The centrifuge rotor according to claim 10, wherein the passage comprises an aperture, which extends through the at least one second conical disk and is provided upstream of the first valve member with respect to the outward direction.

13. The centrifuge rotor according to claim 12, wherein the at least one second conical disk comprises a closing member protruding from the outward surface, and wherein the closing member is configured to close the second interspace and is provided upstream of the aperture with respect to the outward direction.

14. The centrifuge rotor according to claim 3, wherein the check valve comprises at least one second valve member closing the at least one second interspace, and wherein the first and second valve members are provided in series after each other with respect to the outward direction.

15. The centrifuge rotor according to claim 1, wherein the centrifuge rotor comprises a central chamber inside the central opening of the conical disks, and wherein the centrifuge rotor is configured to permit flow in the inward direction in the first interspaces into the central chamber.

16. A centrifugal separator for separation of a relatively heavy phase of a fluid from a relatively light phase of the fluid, the centrifugal separator comprising:

a casing enclosing a separation space having an inlet and an outlet;

the centrifuge rotor according to claim 1 supported within the separation space of the casing; and a device for rotating the fluid and the centrifuge rotor around the central axis of rotation in the separation space.

17. A method for separation of a relatively heavy phase of a fluid from a relatively light phase of the fluid, the method comprising the steps of:

providing a centrifuge rotor within a casing, the centrifuge rotor comprising a stack of conical disks and a central axis of rotation around which the conical disks are concentrically provided, wherein each conical disk has an outward surface and an inward surface, and comprises a central opening, wherein the stack comprises a plurality of interspace between adjacent conical disks, and wherein the interspaces comprise first interspaces and at least one second interspace provided adjacent to one of the first interspaces, rotating the centrifuge rotor;

supplying the fluid and conveying the fluid into the first interspace in which the relatively heavy phase is separated from the relatively light phase;

closing the at least one second interspace in an inward direction towards the central axis of rotation; and permitting opening of the at least one second interspace in an outward direction, opposite to the inward direction, for the relatively heavy phase.

18. A conical disk for a centrifuge rotor for a centrifugal separator for separation of a relatively heavy phase of a fluid from a relatively light phase of the fluid, the conical disk comprising:

a central axis of rotation around which the conical disk is concentrically provided;

an outward surface and an inward surface;

a central opening; and at least one first valve member a check valve, wherein the first valve member is configured to close in an inward direction towards the central axis of rotation, and to open in an outward direction, opposite to the inward direction, and wherein the first valve member is movable between an opening position along the outward surface of the conical disk and a closing position, in which the first valve member extends in the outward direction with respect to the central axis of rotation.

19. The conical disk according to claim 18, wherein, the first valve member is attached to the outer surface of the conical disk and extends in an outward direction with respect to the central axis of rotation.

20. The conical disk according to claim 19, wherein the conical disk comprises an aperture permitting a flow through the conical disk, and wherein the aperture is provided more closely to the central axis of rotation than the first valve member.

* * * * *